United States Patent [19]

Holmes

[11] 4,274,805

[45] Jun. 23, 1981

[54] FLOATING VANE SUPPORT

[75] Inventor: Trent H. Holmes, Rocky Hill, Conn.

[73] Assignee: United Technologies Corporation, Hartford, Conn.

[21] Appl. No.: 948,289

[22] Filed: Oct. 2, 1978

[51] Int. Cl.[3] ..... F01D 25/24

[52] U.S. Cl. ..... 415/138; 415/139

[58] Field of Search ..... 415/136, 138, 139, 137

[56] References Cited

U.S. PATENT DOCUMENTS

| | | | |
|---|---|---|---|
| 2,488,867 | 11/1949 | Judson | 415/136 |
| 2,915,280 | 12/1959 | Sonder | 415/138 |
| 2,968,467 | 1/1961 | McGregor | 415/136 |
| 3,062,499 | 11/1962 | Peterson | 415/137 |
| 3,066,911 | 12/1962 | Anderson | 415/138 |
| 3,072,380 | 1/1963 | Hennig | 415/136 |
| 3,765,791 | 10/1973 | Trappman | 415/138 X |

FOREIGN PATENT DOCUMENTS

| | | | |
|---|---|---|---|
| 572033 | 10/1958 | Belgium | 415/136 |

*Primary Examiner*—Leonard E. Smith

*Attorney, Agent, or Firm*—Gene D. Fleischhauer

[57] ABSTRACT

A structure for supporting an array of stator vanes in an axial flow rotary machine is disclosed. Various construction details related to machine efficiency and machine durability are developed. In one structure, both the concentricity of the ring with respect to the axis of the engine and the diameter of the ring are unaffected by thermal and mechanical distortions of the outer case. A spline-type connection is formed between the ring and the outer case.

5 Claims, 3 Drawing Figures

FLOATING VANE SUPPORT

BACKGROUND OF THE INVENTION

1. Field of the Invention

This invention relates to gas turbine engines, and more particularly to the support of stator vanes in such an engine.

2. Description of the Prior Art

A gas turbine engine has a compressor section and a turbine section and includes a rotor extending axially through the compressor section. A row of rotor blades extends outwardly from the rotor. A stator circumscribes the rotor. The stator includes an outer case and an array of stator vanes extending inwardly from the outer case. A gas stream flows axially through alternate rows of rotor blades and arrays of stator vanes. The rotor blades of the turbine extract energy from the gas stream to drive the rotor blades of the compressor. Commonly, the vanes of each array receive the gas stream from the upstream row of stator blades and direct the gas stream to a downstream row of rotor blades. For successful operation, the rows of rotor blades and the arrays of stator vanes must be concentrically and radially aligned. Concentric alignment of the array of stator vanes is provided by support structure extending inwardly from the outer case.

In one typical engine structure, the stator vanes of each stator array are cantilevered inwardly from support structure attached to the outer case of the stator. U.S. Pat. No. 3,066,911 to Anderson et al. entitled "Nozzle and Turbine Wheel Shroud Support" is representative of cantilevered support structures. In Anderson an outer shroud ring provides support to cantilevered stator vanes and an unsupported inner ring joins together the inner ends of the stator vanes. The gas stream loads on each vane are taken out through the outer end of the vane. This end must resist all of the axial loads and bending moments on that vane.

In another common engine structure the vanes are simply supported between an inner support and an outer support. U.S. Pat. No. 2,968,467 to McGregor entitled "Connecting Means, Especially For Securing Annular Stator Elements Between Supports Whose Positions Are Fixed" shows a representative simply supported vane. The outer support restrains the vane axially and radially and the inner support restrains the vane axially. The gas path loads on each vane are taken out through both ends of the vane. The inner end and the outer end together resist the axial loads and the bending moments on that vane.

Simply supported vane systems are not without problems. Differences in thermal growth between the inner support and the outer support create axial and radial stresses. The support structure in McGregor and other simply supported structures such as U.S. Pat. No. 3,062,499 to Peterson entitled "Vane Mounting and Seal" share this problem. Differences in axial growth between the inner and outer supports subject the stator vane to cyclic stresses and eventual low cycle fatigue failure. In McGregor, the outer support is fastened to the outer case. Thermal excursions of the case cause misalignment between the stator array and the blades of the rotor. In addition to the misalignment problem the distortions and stresses may be severe enough to impair sealing at the inner and outer supports. A loss in engine efficiency and durability results. Thus, even though simply supported vane arrays are stronger and safer than cantilevered arrays, thermal growth problems remain to be solved.

The need to produce energy efficient machines has grown in recent years because of increased fuel costs and limited fuel supplies. Because of the twin needs of economy and safety, research efforts are being directed at decreasing the stresses in arrays of stator vanes and at keeping the vane arrays in alignment with the blades of the rotor.

SUMMARY OF THE INVENTION

A primary aim of the present invention is to provide support for an array of stator vanes in an axial flow rotary machine. Structural isolation of the vane support structure from the engine case is sought, and a specific goal is to hold the stator array in concentric, radial alignment with an adjacent rotor stage. Another goal is to reduce the leakage of working medium gases between the vanes and the engine case.

According to the present invention a continuous ring circumscribes an array of stator vanes attached thereto and engages the engine case at a spline-type connection to position the vane array.

A primary feature of the present invention is the continuous ring to which the vanes of the array are attached. A pin connects each vane of the array to the continuous ring. A ring seal is disposed radially between the ring and the vanes. Another feature is the spline-type connection between the ring and the engine outer case. Still another feature is the rear seal axially disposed between each vane and a downstream stator vane. A tang extends from each vane and engages a corresponding slot in the inner case.

A principal advantage of the present invention is the decrease in gas stream flow losses as a result of the concentric, radial alignment between the vane array and the downstream rotor blades. The fatigue strength of the support structure is improved by allowing independent movement of the continuous ring and the outer case at a spline connection. The complexity of the support structure is reduced by passing the axial loads at the outer end of each vane array rearwardly to a single support on the outer case. The sealing effectiveness is increased by avoiding distortions of the seal sealing surfaces.

The foregoing, and other objects, features and advantages of the present invention will become more apparent in the light of the following detailed description of the preferred embodiment thereof as shown in the accompanying drawing.

DESCRIPTION OF THE PREFERRED EMBODIMENT

A gas turbine engine embodiment of the invention is described. The concepts are equally applicable to gas generators and free turbines.

Figure 1:
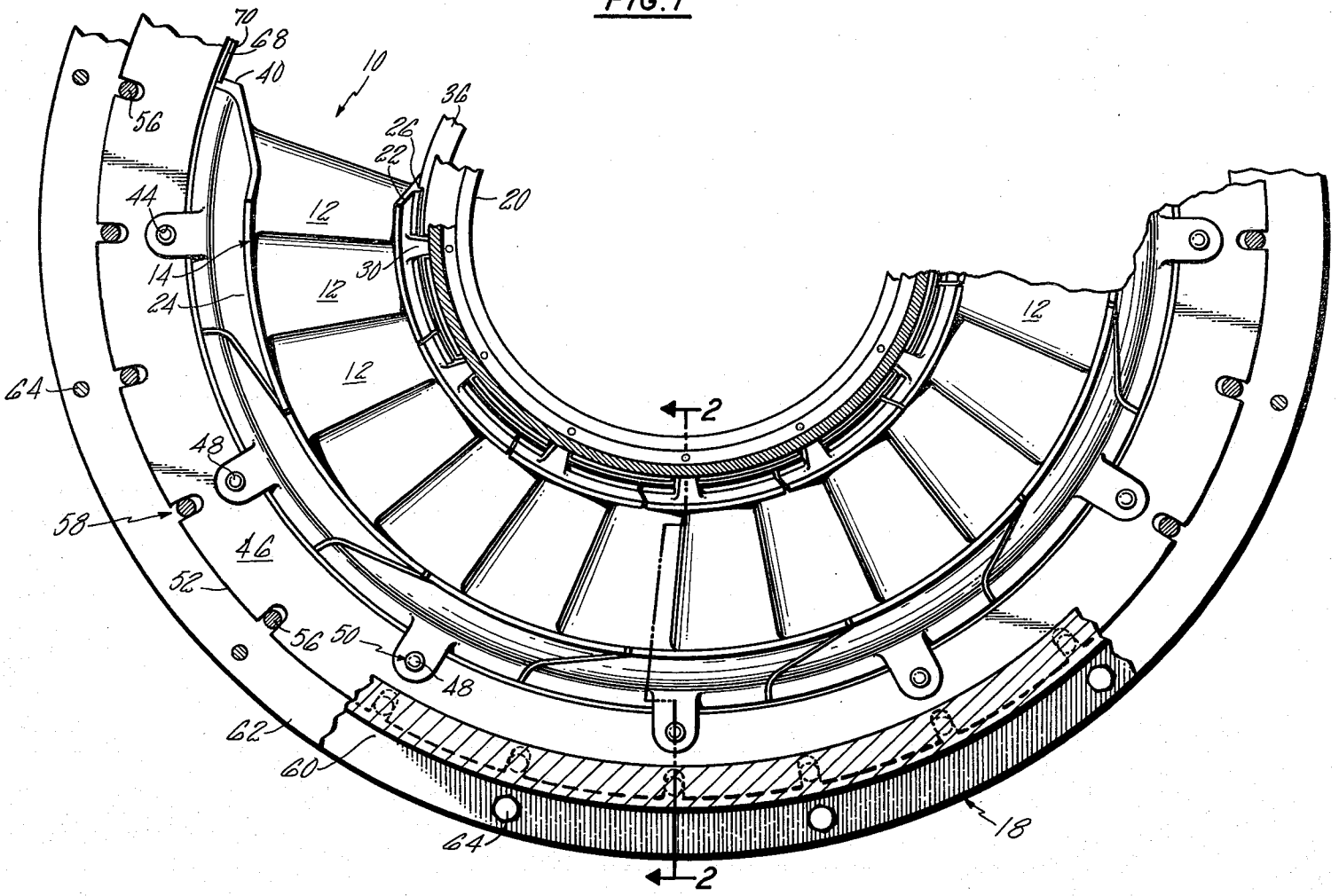
FIG. 1 is a partial cross section view of a stator looking in the aft direction with portions of the outer case broken away.

FIG. 1 illustrates a portion of an array 10 of stator vanes 12. The vane array is formed of a plurality of clusters 14, each cluster having two vanes.

Figures 2, 3:
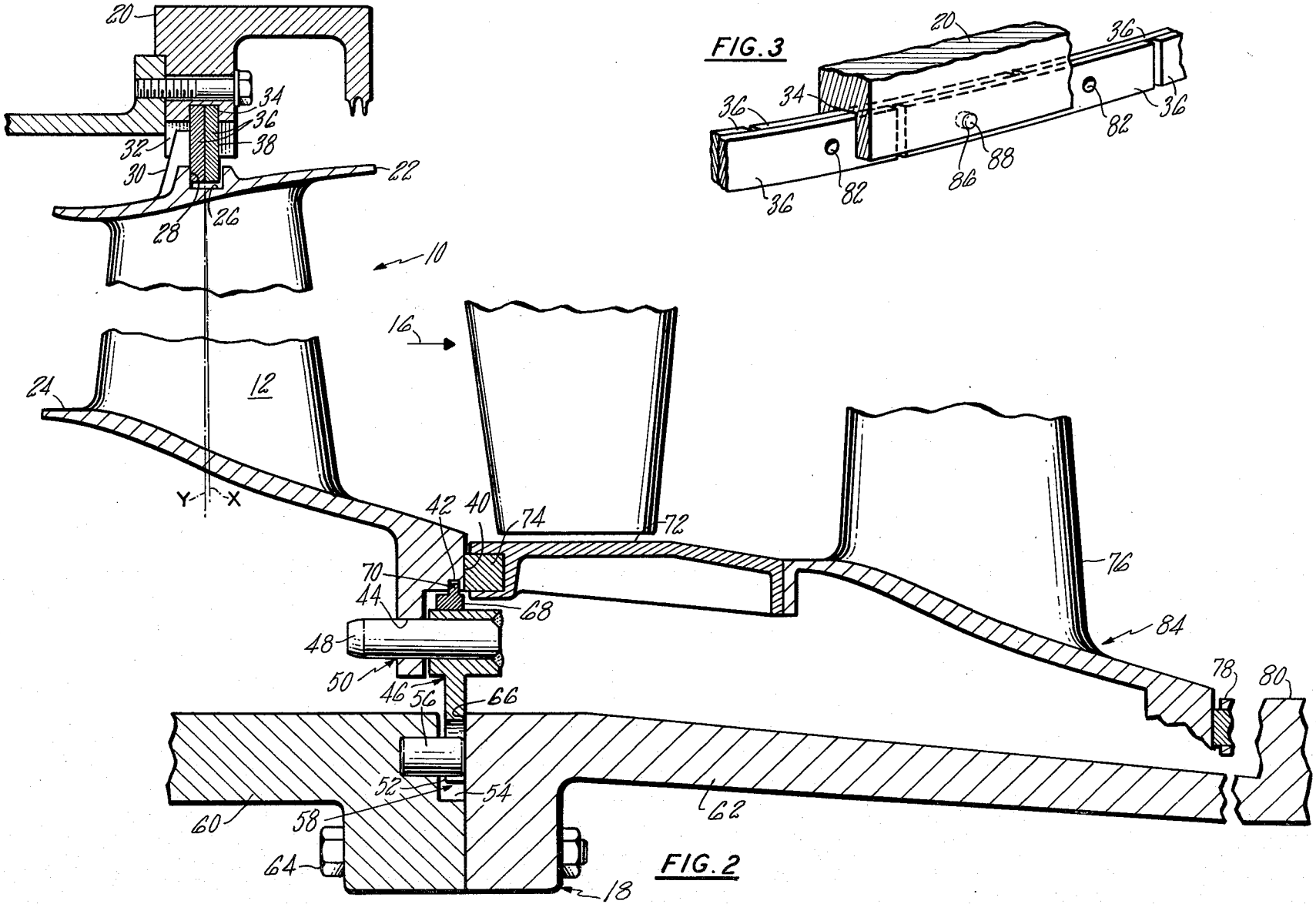
FIG. 2 is a directional view taken along the line 2—2 as shown in FIG. 1.
FIG. 3 is a perspective view of a fragment of the inner support structure.

As shown in FIG. 2, the vanes of each cluster extend across an annular gas stream flow path 16 between an outer case 18 and an inner case 20. Each cluster has an inner flange 22 and an outer flange 24. The inner flange has a circumferentially extending seal groove 26 having a seal lip 28. A tang 30 extends beyond the seal lip to engage a corresponding slot 32 in the inner case. The inner case also has a support channel 34 engaging seal segments 36. Each seal segment engages the inner case and at least one vane cluster. The seal segments 36 and the rear wall of the support channel 34 comprise an inner axial support structure 38. The vane outer flange 24 has a rear surface 40, a groove 42, and a plurality of holes 44. A continuous ring 46 circumscribes a portion of each vane outer flange. A plurality of pins 48 extend axially from the continuous ring. The pins are circumferentially spaced around the continuous ring. Each pin slidingly engages a corresponding hole 44 in each vane cluster 14 to form a joint 50. The continuous ring also has a plurality of splines 52. The outer case 18 has a circumferentially extending slot 54. The splines extend radially outward into the slot. Each spline engages the outer case 18 through a corresponding pair of circumferentially spaced case pins 56 with the plurality of such engagements forming a spline-type connection 58. Each case pin 56 extends rearwardly from a first case member 60 between each pair of adjacent splines toward a second case member 62. The first case member 60 and the second case member 62 form a portion of the outer case 18 and are joined together by a plurality of bolts 64 circumferentially spaced around the outer case.

The circumferentially extending slot 54 is shown as being in the first case member 60. The splines and a portion of the continuous ring 46 abut the upstream face 66 of the second case member 62. A one-piece ring seal 68 is contiguous to the inner diameter of the continuous ring 46. The ring seal has a radially inwardly extending tongue 70 engaging the grooves 42 in the vane outer flanges. A first blade tip seal 72 is axially adjacent to the outer flanges of the vane clusters 14. A rear seal 74 is housed in the upstream end of the first blade tip seal. The rear seal is separated into segments. Each segment circumferentially abuts the adjacent segments. The rear surfaces 40 of the vane outer flanges abut the rear seal 74. Adjacent to the first blade seal 72 is a downstream vane cluster 76. The downstream vane cluster is also adjacent to a second blade tip seal 78. The second blade tip seal engages the second case member 62 at an axial support 80. The rear seal 74, the first blade tip seal 72, the downstream vane cluster 76, the second blade tip seal 78 and the axial support 80 comprise an outer axial support structure 84.

FIG. 3 shows in more detail the cooperation between the inner case 20, the support channel 34 and the seal segments 36. The seal segments 36 overlap each other and have circumferentially spaced axially aligned holes 82. Inner case 20 has holes 86 axially aligned with the holes in the seal segment. Each pin 88 passes through a hole 82 in one seal segment, a hole 82 in the overlapping seal segment and a hole 86 in the inner case.

During operation of a gas turbine engine, hot working medium gases flow axially into a turbine section of the engine. Components of the turbine, including the vane array 10 the outer case 18 and the inner case 20 are heated by the medium gases. The ring which supports the vanes 12 of the array is in near proximity to the medium gases and responds rapidly to temperature fluctuations of the gases. The outer case is remotely located with respect to the medium gases and has a high thermal capacity with respect to the ring. Accordingly, the case responds more slowly to temperature fluctuations than does the ring and the radial distance between the outer case and the ring varies during transient operation conditions.

The thermal response of the ring 46 is matched to the response of the rotor such that the blades of the rotor and the vanes supported by the ring are held in aligment along the flow path. Although the ring is carried by the outer case, the concentricity of the ring with respect to the axis of the engine and the diameter of the ring are unaffected by thermal and mechanical distortions of the outer case 18.

As the ring grows outwardly toward the case, as for example during acceleration of the engine, the splines 52 move outwardly along the pins 48. As the ring contracts inwardly away from the case, as for example during deceleration of the engine, the splines move inwardly along the pins.

The continuous ring 46 and the ring seal 68 block axial leakage of the working medium gases between the vanes of the array and the outer case during all operating conditions of the engine, including the transient conditions described above. The continuous ring 46 presses against the overlap seal surface 66 to block leakage between the ring and the outer case. The ring seal blocks the leakage of working medium gases between the ring and the vane. In at least one embodiment, the ring seal is of a one-piece continuous construction and is matched in thermal response characteristics to the continuous ring 46. The tongue 70 of the ring seal slides in the groove 42 of each vane outer flange to compensate for any radial growth differences between the vane outer flange and the ring seal.

In response to the pressure of the working medium gases on the vanes, each cluster 14 adjusts rearwardly along a pin 48 of the continuous ring into abutting relationship with the outer axial support structure 84 and the inner axial support structure 38 to simply support the vane cluster 14. The seal segments 36, secured to the inner case 20, transmit the pressure of the working medium gases rearwardly from the vane inner flange 22 to the inner case. The seal segments contact the tang 30 and the seal lip 28 over a sufficient length to ensure engagement notwithstanding the expansions and contractions of the vanes in response to changes in the working medium temperatures. Concomitantly, the seal segment block the axial leakage of the working medium between the vane clusters and the inner case. At the outer axial support structure, the rear seal 74 cooperates with the rear surface 40 of the vane cluster to form a radial seal blocking the escape of working medium gases from the medium flow path.

Also, in response to the pressure of the working medium gases the vanes are urged circumferentially bringing each vane cluster into restraining engagement with a corresponding pin on the continuous ring 46 and a slot 32 on the inner case 20.

The axial thermal responses of the inner and outer support structures are closely matched. The inner support is surrounded by the hot working medium gases of the flow path. The outer support is in intimate contact with the gases over its full length. Nevertheless, small predictable differences in axial growth must be accommodated by tilting the installed vanes such that during operation the centerline of the vane lies in plane Y, a plane perpendicular to the axis of the engine. The installed vane lies in plane X, a plane tilted with respect to plane Y. The tilt is shown in FIG. 2.

Although this invention has been shown and described with respect to a preferred embodiment thereof, it should be understood by those skilled in the art that various changes and omissions in the form and detail thereof may be made therein without departing from the spirit and scope of the invention.

Having thus described a typical embodiment of my invention, that which I claim as new and desire to secure by Letters Patent of the United States is:

1. A rotary machine having an axially extending flow path with an upstream end and a downstream end, which comprises:

an outer case having a central axis and a plurality of pins at the interior thereof wherein the pins are oriented in an essentially axial direction;

a continuous ring having splines extending outwardly therefrom to engage the pins wherein said pins and splines are adapted to accommodate relative differential growth of the ring with respect to the case;

a vane cluster disposed across the flow path and having an outer flange, the outer flange engaging the continuous ring wherein said vane cluster is adapted to adjust rearwardly with respect to the outer case; and an axial support structure, which is adjoined to the outer case at a point downstream of the radial engagement between the continuous ring and the outer case, positioned to engage the vane cluster as the vane cluster adjusts rearwardly during operation.

2. The invention according to claim 1 wherein the outer flange slidably engages the continuous ring so as to be rearwardly adjustable with respect thereto.

3. The invention according to claim 1 claim 2 wherein said rotary machine has an inner case and said vane cluster has an inner flange, and which further includes means extending from the inner case to support the array of stator vanes in an axial position.

4. The invention according to claims 1 or 3 which further includes a ring seal extending between said continuous ring and said outer flange.

5. The invention according to claims 1 or 3, which further includes a rear seal housed within said axial support structure which abuts said outer flange as the vane adjusts rearwardly.

* * * * *

UNITED STATES PATENT AND TRADEMARK OFFICE

CERTIFICATE OF CORRECTION

PATENT NO. : 4,274,805

DATED : June 23, 1981

INVENTOR(S) : Trent H. Holmes

It is certified that error appears in the above—identified patent and that said Letters Patent is hereby corrected as shown below:

| | |
|---|---|
| Col. 4, line 52 | "segment" should be -- segments -- |
| Col. 6, claim 3, line 13 | "claim 2" should be deleted |

Signed and Sealed this

First Day of December 1981

[SEAL]

Attest:

GERALD J. MOSSINGHOFF

Attesting Officer

Commissioner of Patents and Trademarks